US007147219B2

(12) United States Patent
Soo

(10) Patent No.: US 7,147,219 B2
(45) Date of Patent: Dec. 12, 2006

(54) PRINTER PAPER TRAY

(75) Inventor: Eng Leong Soo, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 354 days.

(21) Appl. No.: 10/843,749

(22) Filed: May 11, 2004

(65) Prior Publication Data

US 2005/0253327 A1 Nov. 17, 2005

(51) Int. Cl.
*B65H 1/26* (2006.01)

(52) U.S. Cl. ..... 271/157; 271/160; 271/162

(58) Field of Classification Search ..... 271/162, 271/163, 157, 164, 160
See application file for complete search history.

(56) References Cited

U.S. PATENT DOCUMENTS 4,087,178 A * 5/1978 Pfeifer et al. ..... 355/72
4,280,692 A * 7/1981 Hutchinson et al. ..... 271/160
4,623,137 A * 11/1986 Irie et al. ..... 271/160
5,181,713 A * 1/1993 Neugebauer ..... 271/160
5,228,677 A * 7/1993 Asakawa ..... 271/126

* cited by examiner

*Primary Examiner*—David H. Bollinger

(57) ABSTRACT

A paper tray (110, 210, 310, 410, 510, 610, 710, 810) for holding a stack of sheets of paper in a printer (540, 640, 740, 840) is provided. The paper tray includes an actuator (221, 421, 521, 621, 721, 821), which is moveable between an engaged position by insertion of the tray into the printer and a refilling position by at least partial removal of the tray from the printer. A paper supporting plate (230, 330, 430, 530, 630, 730, 830) is moveably coupled to the actuator. The paper supporting plate supports the stack of paper so that a sheet furthest away from the paper supporting plate is in a picking position available for picking by the printer, when the actuator is in the engaged position. The actuator is coupled to the paper supporting plate so as to move the paper supporting plate away from the picking position when the actuator is moved into the refilling position.

7 Claims, 10 Drawing Sheets

PRINTER PAPER TRAY

FIELD OF THE INVENTION

The present invention relates to paper trays for storing paper to be used in printing. In particular, the present invention relates to trays having mechanisms for supplying paper to a printer.

BACKGROUND OF THE INVENTION

Inkjet, deskjet and laserjet printers have a paper tray to store a paper stack for printing. From this tray, stored paper is positioned for picking (removal from the paper stack) and then transported for printing.

The paper in a paper tray is generally moved into a position from which the paper can be picked, in order to aid picking of the paper by the printer, when the tray has been inserted into a printer. Technically, the mechanisms for placing paper in a position from which the paper can be picked may be contained within both the tray and the printer, whereby the mechanisms interact with one another. Having two separate mechanisms, which come together in order to function properly, makes it desirable to have high dimensional accuracy and low levels of stack tolerances (the mismatch between the height of the top of the stack of paper in the tray and the paper receiving part of the printer). Additionally, high cost may be incurred both from the high number of parts and from the assembly of these complicated mechanisms.

For a user loading paper, depending on the tray being used, a specific set of do's, don'ts and check procedures are performed to ensure the product functions correctly. Failure to do so may result in paper not being picked. Such a set of check procedures may not be regarded as user-friendly or robust. Within repair centers, failure of mechanisms to elevate paper for pick results in repairs (or even replacement) of the printer or the tray or both, which is a very costly solution. In addition, trouble-shooting for the root cause of such a picking problem can be time consuming and tedious.

SUMMARY OF THE INVENTION

An embodiment of the invention provides a paper tray for holding a stack of paper in a printer. The paper tray includes an actuator, which is moveable between an engaged position by insertion of the tray into the printer and a refilling position by at least partial removal of the tray from the printer. A paper supporting plate is moveably coupled to the actuator wherein the paper supporting plate supports the stack of paper so that a sheet furthest away from the paper supporting plate is in a picking position available for picking by the printer, when the actuator is in the engaged position. The actuator is coupled to the paper supporting plate to move the paper supporting plate away from the picking position when the actuator is moved into the refilling position.

Other aspects and advantages of the present invention will become apparent from the following detailed description, taken in conjunction with the accompanying drawings, illustrating by way of example the principles of the invention.

BRIEF DESCRIPTION OF THE DRAWINGS

Embodiments of the invention will now be described, purely by way of example, with reference to the accompanying drawings, in which.

DETAILED DESCRIPTION

Figure 1:
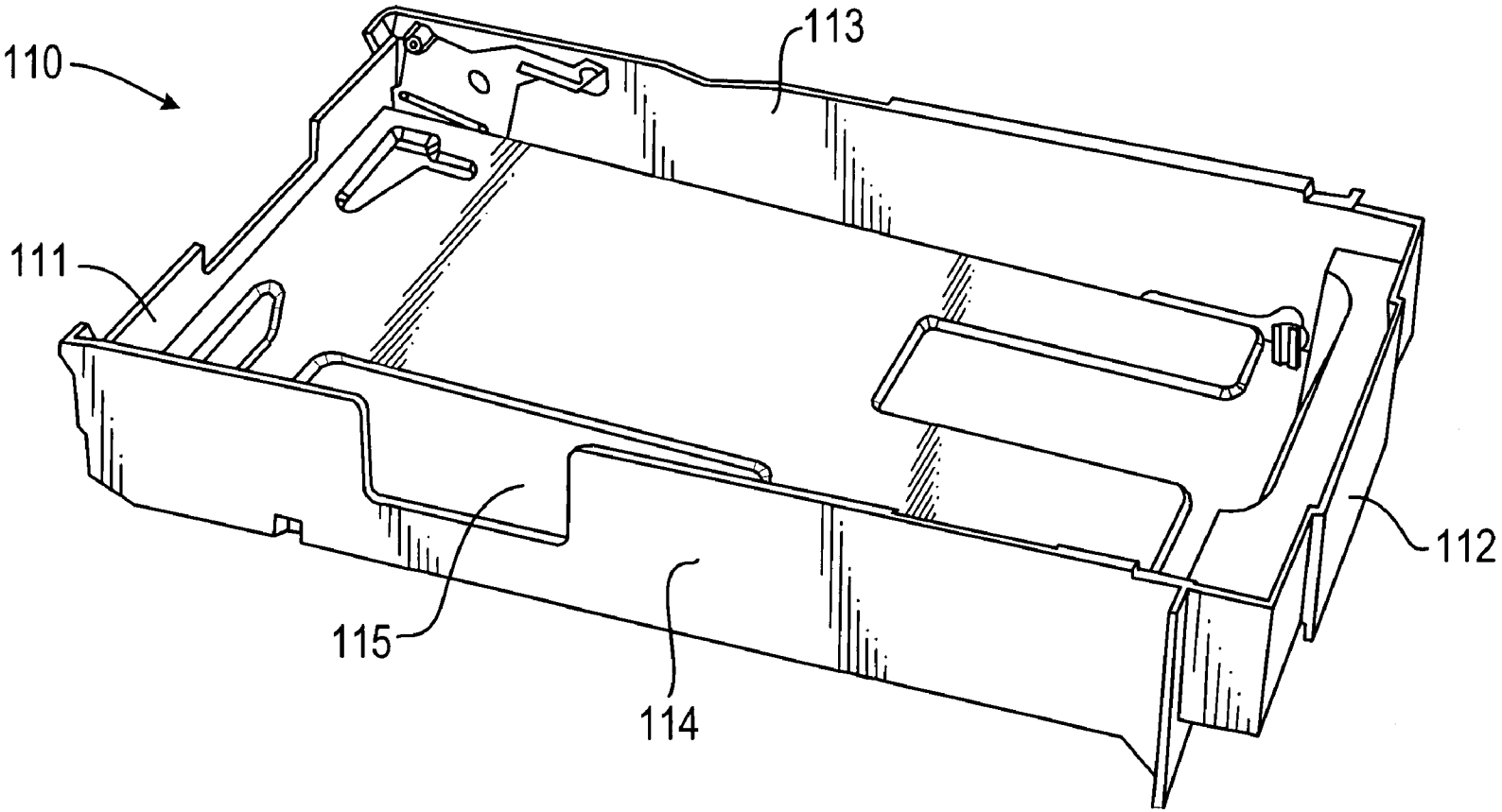
FIG. 1 shows a paper tray according to an embodiment of the invention.

FIG. 1 shows a paper tray 110 for use with a front-loading printer, according to embodiments of the present invention. The tray 110 has a front end 111, which is designed to be inserted into a printer first, and a rear end 112, at the other end of the tray 110. The tray 110 also has first and second sides 113, 114, between the front and rear ends 111, 112 on each side of the tray 110, and a base 115, from which the sides 113, 114 and ends 111, 112 extend upwardly when the base 115 is placed horizontal.

Figure 2:
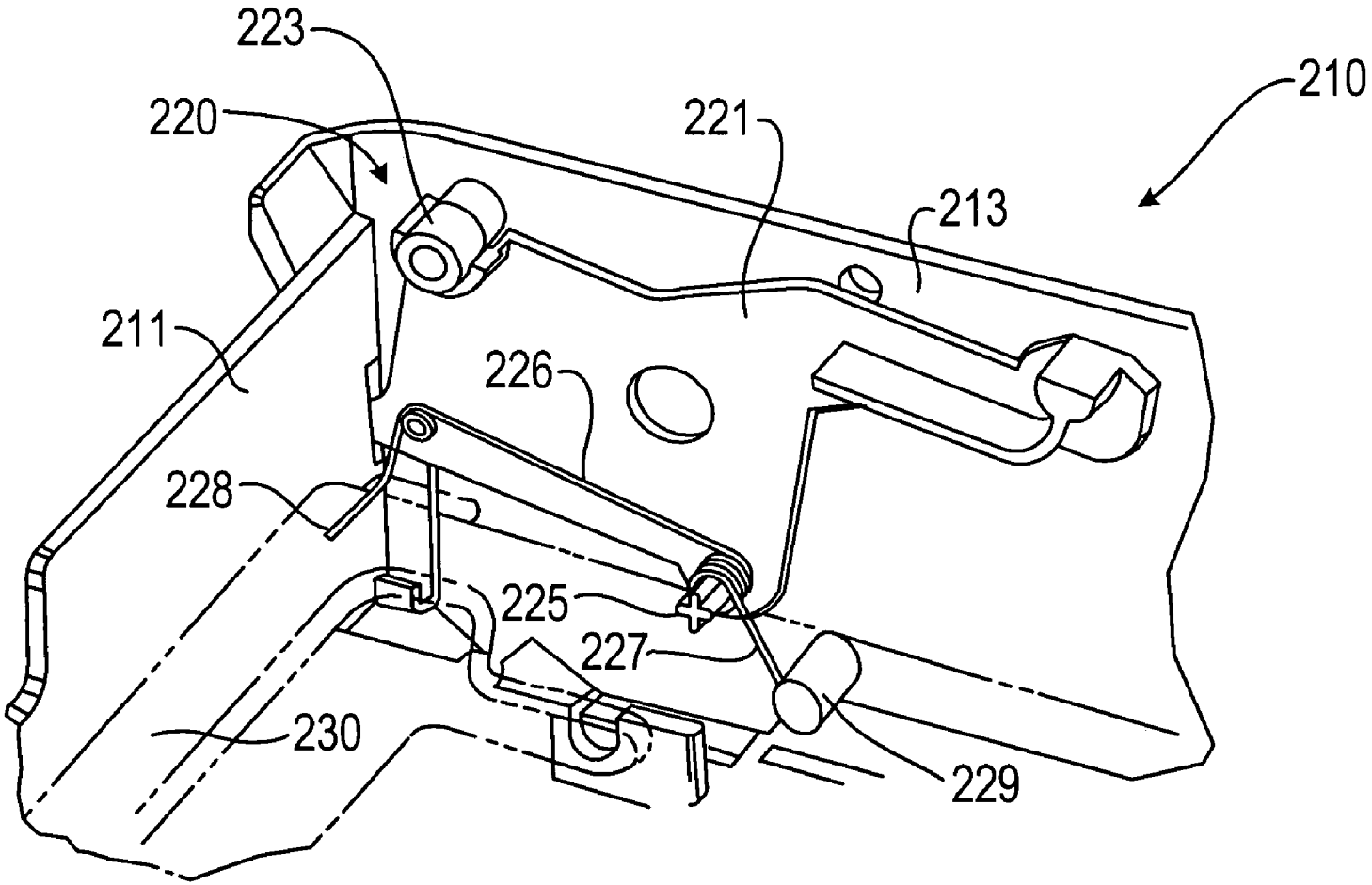
FIG. 2 shows a mechanism of a paper tray according to an embodiment of the invention.

As shown in FIG. 2, a mechanism 220 according to an embodiment of the invention is mounted within a tray 210. The mechanism 220 includes an actuator 221 pivotably connected to the first side 213 of the tray 210 adjacent to the front end 211. In this embodiment, the mechanism includes another actuator, provided on the second side of the tray. In this embodiment, each actuator is a mirror image of the other in a plane parallel to the first and second sides 213, (not shown). Therefore, only one side of the mechanism 220 will be described, as the other side corresponds and functions in the same way. The mechanism 220 is pivotally connected via a cylinder 223 extending laterally from the actuator 221 and engages with the internal surface of a cylindrical hole (not shown) in the first lateral side of the tray 210.

The cylinder 223 comprises two substantially half cylinders with a gap therebetween, and whereby each half cylinder includes a radially outwardly facing flange (not shown) on the end. The flanges extend radially by more than the diameter of the hole. The cylinder 223 is attached to the first side 213 of the tray 210 by insertion of the cylinder into the hole. The two half cylinders deform towards one another to reduce the radial extent of the flanges and allow the half cylinders through the hole. The flanges then engage the opposite surface of the first side 213 of the tray 210 to that on which the actuator is positioned. The actuator 221 is thus attached to the first side of the tray 210, while allowing pivotal movement of the actuator 221 relative to the first side 213 about the connection point between the actuator 221 and the first side 213.

The actuator 221 further includes a projection 225, projecting from the opposite side of the actuator 221 to the cylinder 223. The projection 225 receives a spiral section of a biasing part in the form of a torsion spring 226. The torsion spring 226 has first and second ends 227, 228. The spring 226 abuts a retaining stopper 229 on the internal surface of the first side 213 of the tray 210 in the region of the first end 227. The second end 228 is bent to form a region extending away from the first side 213 of the tray 210. A second torsion spring is provided on the second side of the tray 210, which functions in the same manner.

A paper supporting plate 230 is also provided (which is shown semitransparent in the Figure, in order to aid understanding of the mechanism). The purpose of the paper supporting plate 230 is to support a stack of paper within the tray 210. The stack of paper generally includes a plurality of sheets of paper stacked one above the other, with the top of the stack being furthest away from the paper supporting plate 230. The paper supporting plate 230 is supported in the region of a front end 211 of the tray 210 by the second end 228 of the torsion spring 226. The second end 228 of the torsion spring 226 can slide along a surface of the paper supporting plate 230 opposed to a surface supporting the stack of paper, while supporting the paper supporting plate 230.

Figure 3:
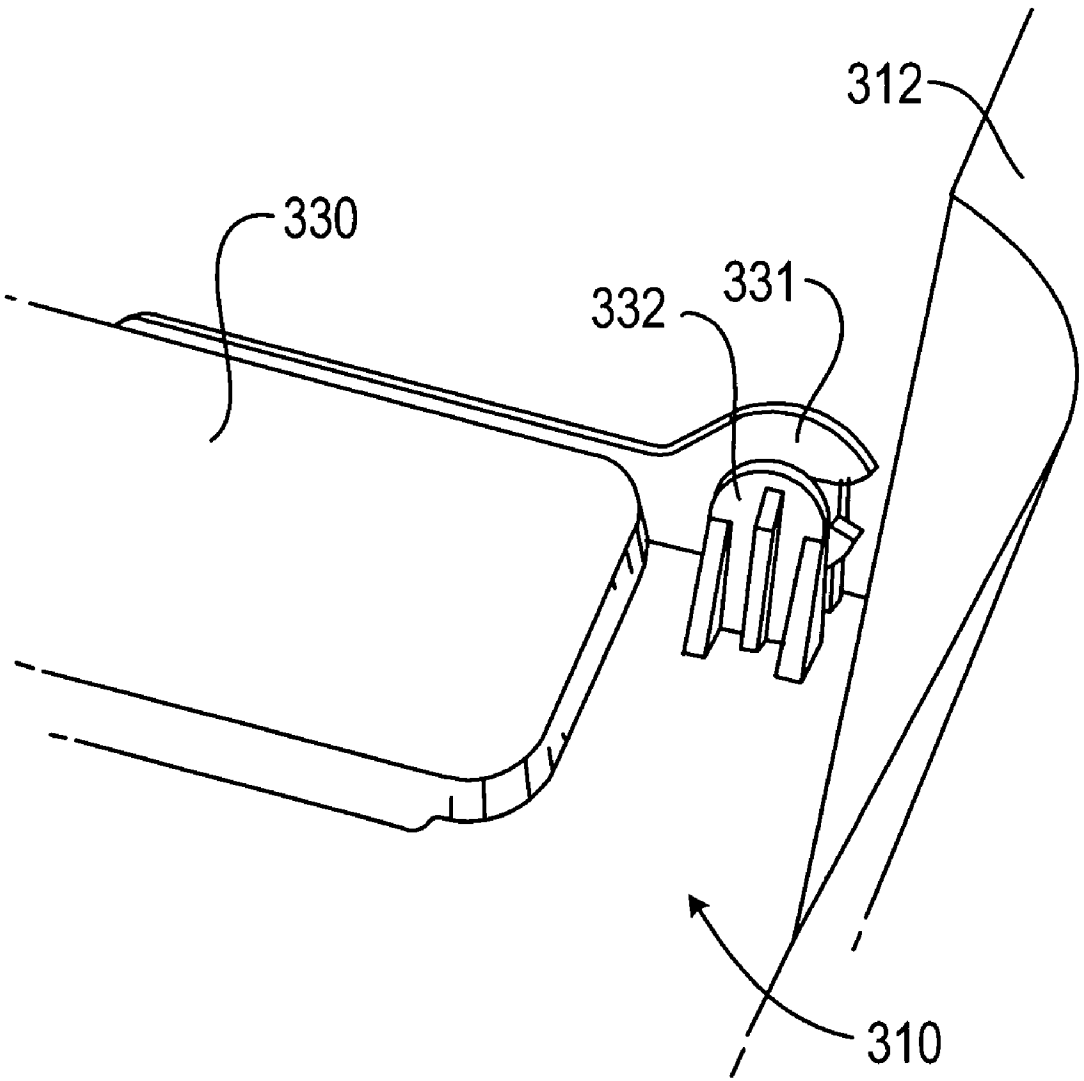
FIG. 3 shows a part of a tray according to an embodiment of the invention.

As shown in FIG. 3, at a rear end 312 of the tray 310, corresponding to the tray 210 shown in FIG. 2, the paper supporting plate 330, corresponding to the paper supporting plate shown in FIG. 2, has a clasp 331, which engages a hinge 332 mounted on the tray 310. The clasp 331 is discontinuous so that the paper supporting plate 330 can be removed from the tray 310 if required. The clasp 331 can rotate about the hinge 332. A second clasp and hinge are provided in the region of the second side (not shown) of the tray 310, which functions in the same manner as described above.

Figure 4:
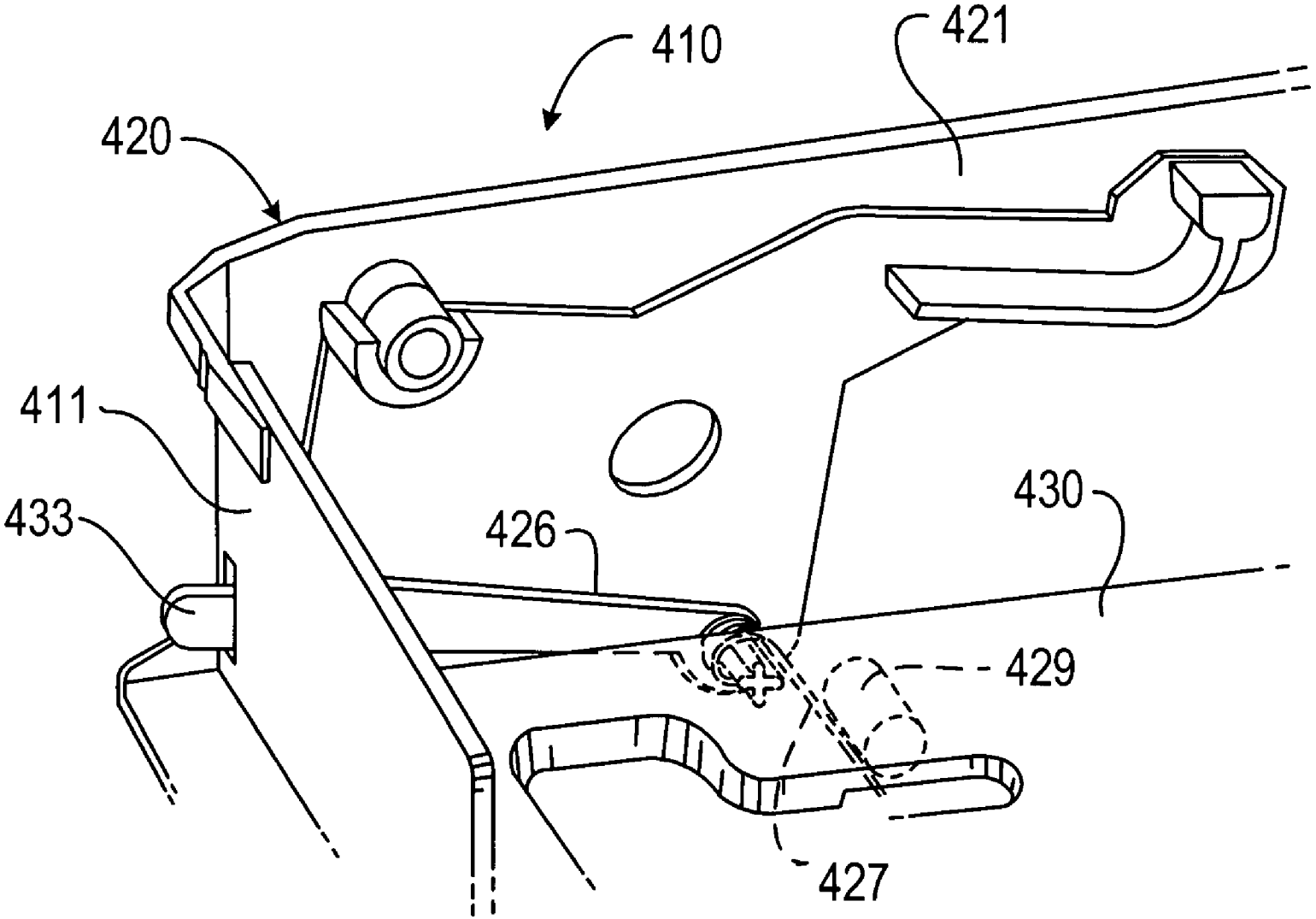
FIG. 4 shows a further view of the mechanism of FIG. 2 in accordance with an embodiment of the invention.

FIG. 4 shows the mechanism 420 of an embodiment of the invention in a first, default or refilling position. As can be seen in FIG. 4, the actuator 421 also has a tab 433, which protrudes through the front end 411 of the tray 410. The weight distribution of the actuator 421 causes the rear end of the actuator 421 to fall under gravity when the tab 433 is not abutting an abutting part 440 of the printer so placing the actuator 421 in the refilling position by default.

Figure 5:
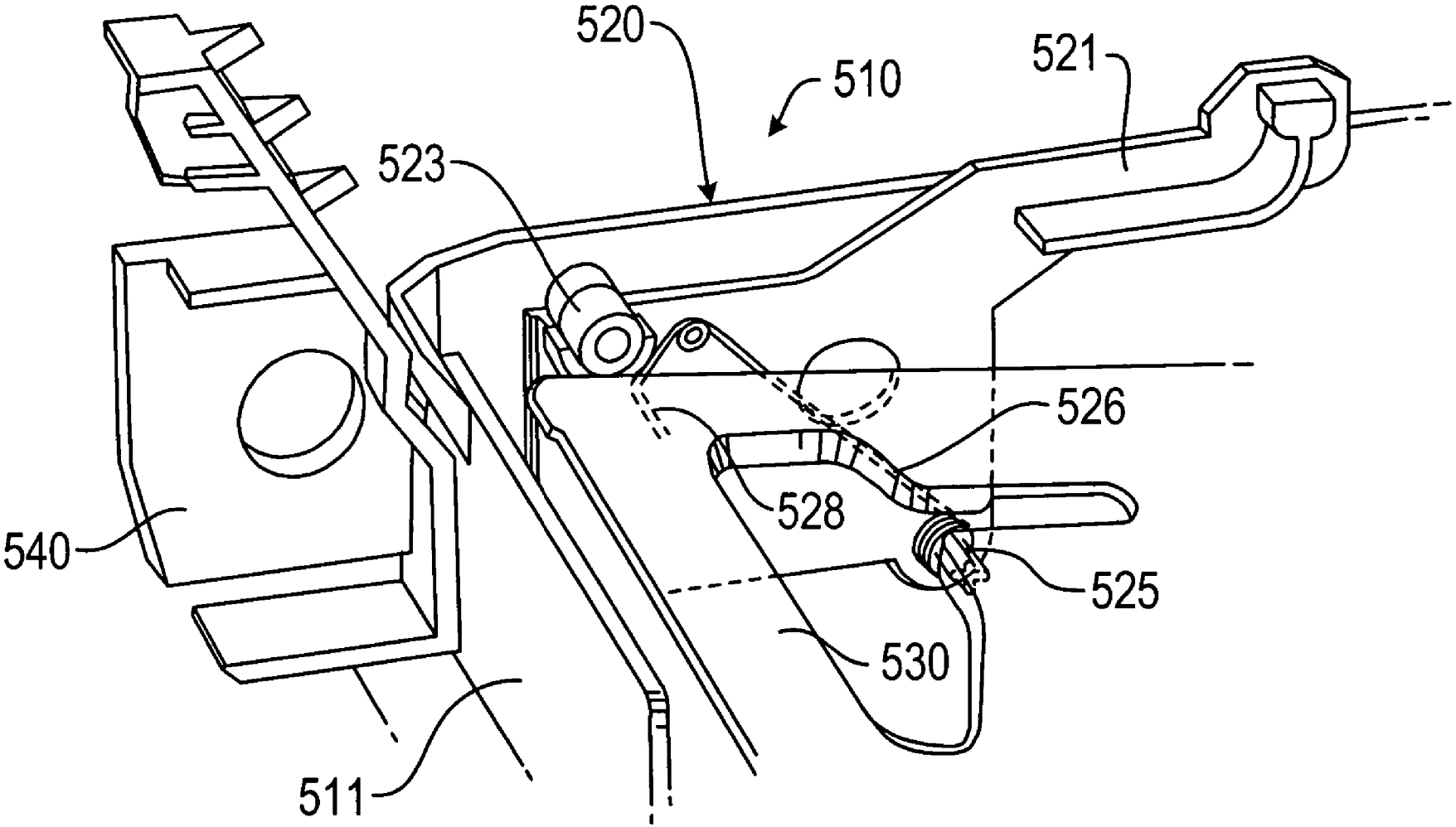
FIG. 5 shows the mechanism of FIGS. 2 and 4 in accordance with an alternate embodiment of the present invention.

FIG. 5 shows part of a tray 510 and a mechanism 520 of an embodiment of the invention in a second or engaged position. The elements of the tray 510 and mechanism 520 are as described above. When the tray 510 is pushed into the printer, the tab (not shown) abuts the abutting 540 part of the printer. The abutting part 540 of the printer causes the tab to be pushed through the hole in the front end 511 of the tray 510, which, in turn, causes the actuator 521 to rotate anti-clockwise (as shown in the figures) about the pivot mounting 522, 523. This anti-clockwise rotation of the actuator 521 causes the projection 525 on the actuator 521 to rotate anti-clockwise. This anti clockwise rotation changes the relative positions of the projection 525 and a retaining stopper (not shown), corresponding to that shown in FIG. 2, which stopper in turn causes the torsion spring 526 to rotate clockwise about the projection 525 on the actuator 521.

The clockwise rotation of the torsion spring 526 causes the second end 528 of the torsion spring 526 to rise upwards by a cantilever action, without significantly affecting the torsion force held in the torsion spring 526. Since the second end 528 of the torsion spring 526 is supporting the paper supporting plate 530, the paper supporting plate 530 also rises, rotating about the hinge at the rear of the tray 510, during the anti-clockwise movement of the actuator 521 as the tray is inserted into a printer. The paper supporting plate 530 is raised into a paper providing position, in which the uppermost sheet of a stack of papers, i.e. the sheet of paper at the top of the stack, is in a picking position, available to be picked from the stack by the printer. The uppermost sheet is picked using a conventional printer picking mechanism (not shown) and method.

When the tray 510 is at least partially removed from the printer, the tab no longer abuts the abutting part 540 of the printer, and the actuator 521 returns to its default state of the refilling position. In doing so the actuator 521 rotates clockwise, which changes the relative positioning of the projection 525 and stopper causing the torsion spring 526 to rotate anti-clockwise, while not substantially affecting the torsion force held in the torsion spring 526. The second end 528 of the spring 526 lowers, which in turn lowers the paper supporting plate 530, lowering the top of the stack of paper away from the picking position. This moving of the paper supporting plate away from the picking position facilitates insertion of sheets of paper into the tray, and insertion of the tray 510 into the printer without the stack of paper interfering with the picking mechanism of the printer.

As described above, the insertion of the tray 510 into a printer causes the paper supporting plate 530 to rise upwards. When the tray 510 is inserted into the printer, the paper supporting plate 530 is retained such that the top of the stack of paper is in the picking position. When the tray 510 is at least partially removed from the printer, i.e. removed enough for the tab not to be abutting the abutting part 540 of the printer, the actuator 521 rotates to the refilling position. When in the refilling position, the paper supporting plate 530 is lowered considerably and the paper stack on the paper providing plate 530 is therefore also lowered from the picking position considerably. In this way, it is possible to add more paper to the stack, or insert a new stack of paper into the tray 510, and onto the paper supporting plate 530, without the possibility of fouling the printer picking mechanism (not shown).

Figure 6:
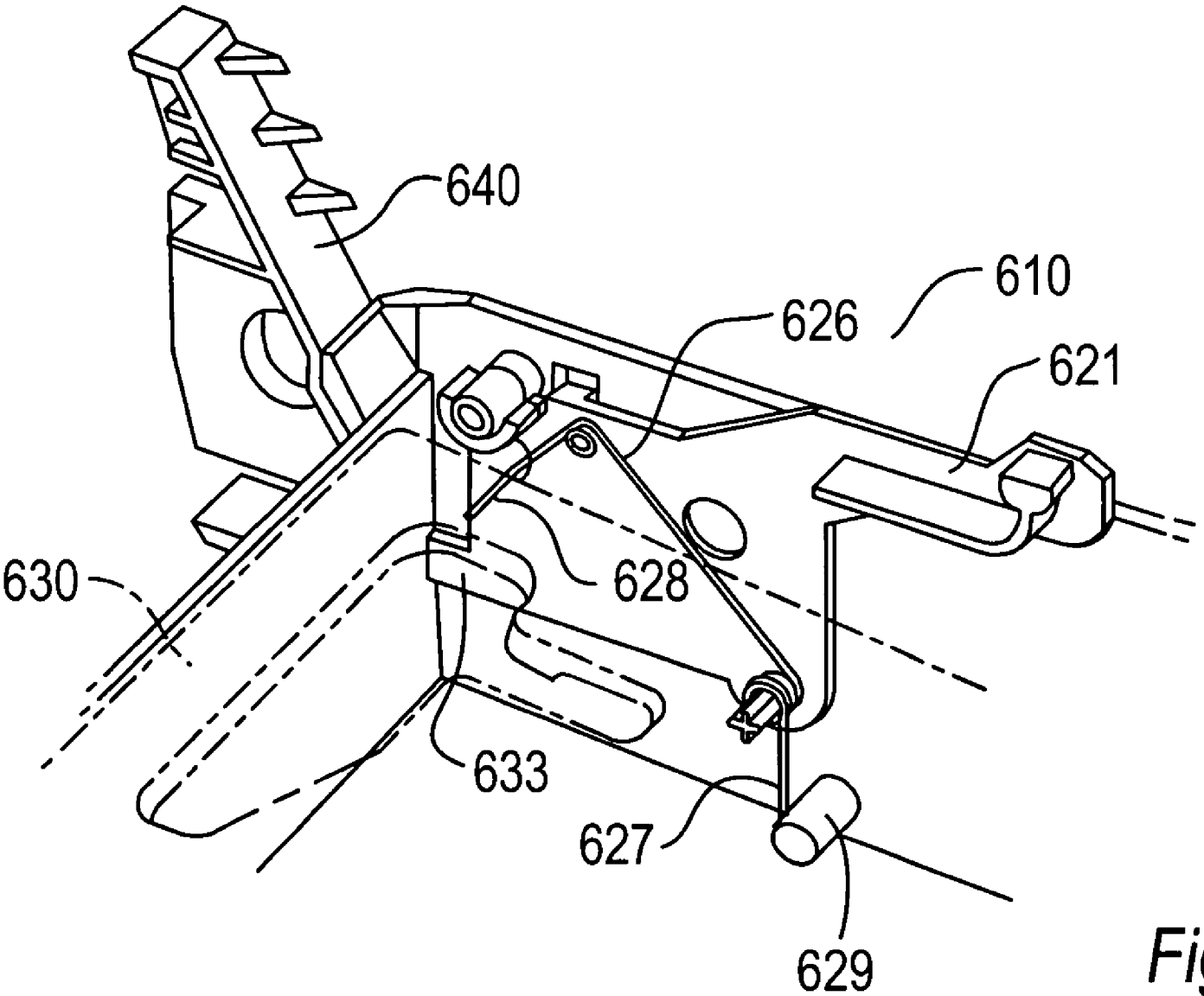
FIG. 6 shows the mechanism of FIGS. 2, 4 and 5 in accordance with an alternate embodiment of the present invention.

FIG. 6 shows view of a mechanism of an embodiment of the invention, corresponding to that described with regard to FIG. 5. FIG. 6 shows the position of the paper supporting plate 630 when the tray 610 is inserted into a printer so that the tab 633 abuts the abutting part 640 of the printer and the actuator 621 is in the engaged position. FIG. 6 shows the configuration of the torsion spring 626 when there is no paper on the paper supporting plate 630.

Figure 7A:
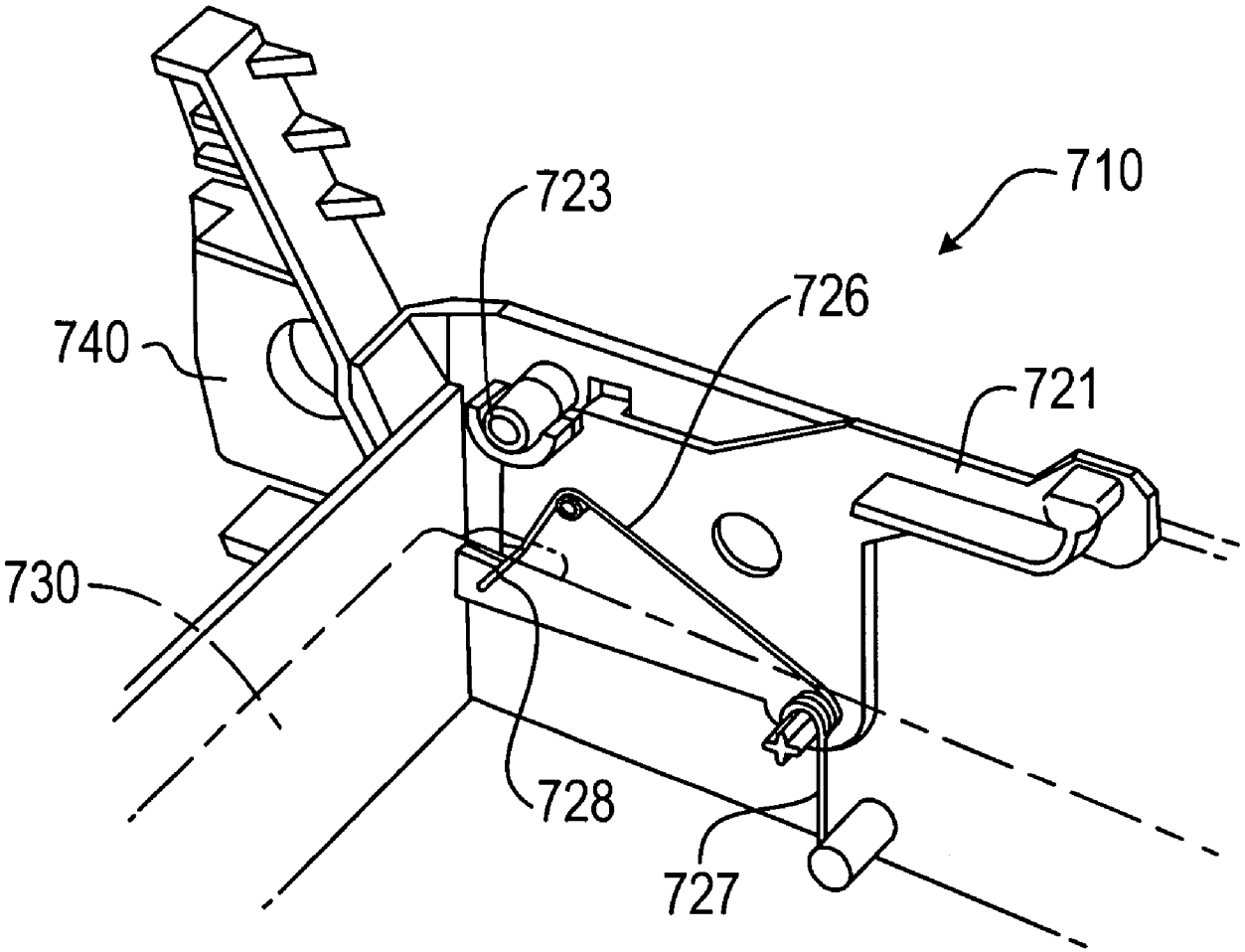
FIGS. 7*a, b* and *c* show the mechanism of FIGS. 2 and 4 to 6 in accordance with alternate embodiments of the present invention.

FIG. 7*a*, shows a mechanism corresponding to that described with regard to FIG. 5, in the same situation as FIG. 6, except that the paper supporting plate 730 is now supporting a stack of paper (the paper itself is not shown for clarity). The torsion spring 726 is under torsion from the weight of the paper on the plate 730. Therefore, second end 728 of the spring 726 is lower, due to the weight of the paper causing elastic deformation of the torsion spring 726. The top sheet of paper is at the picking position, i.e. the correct height to be picked by the picking mechanism of the printer.

Figure 7B:
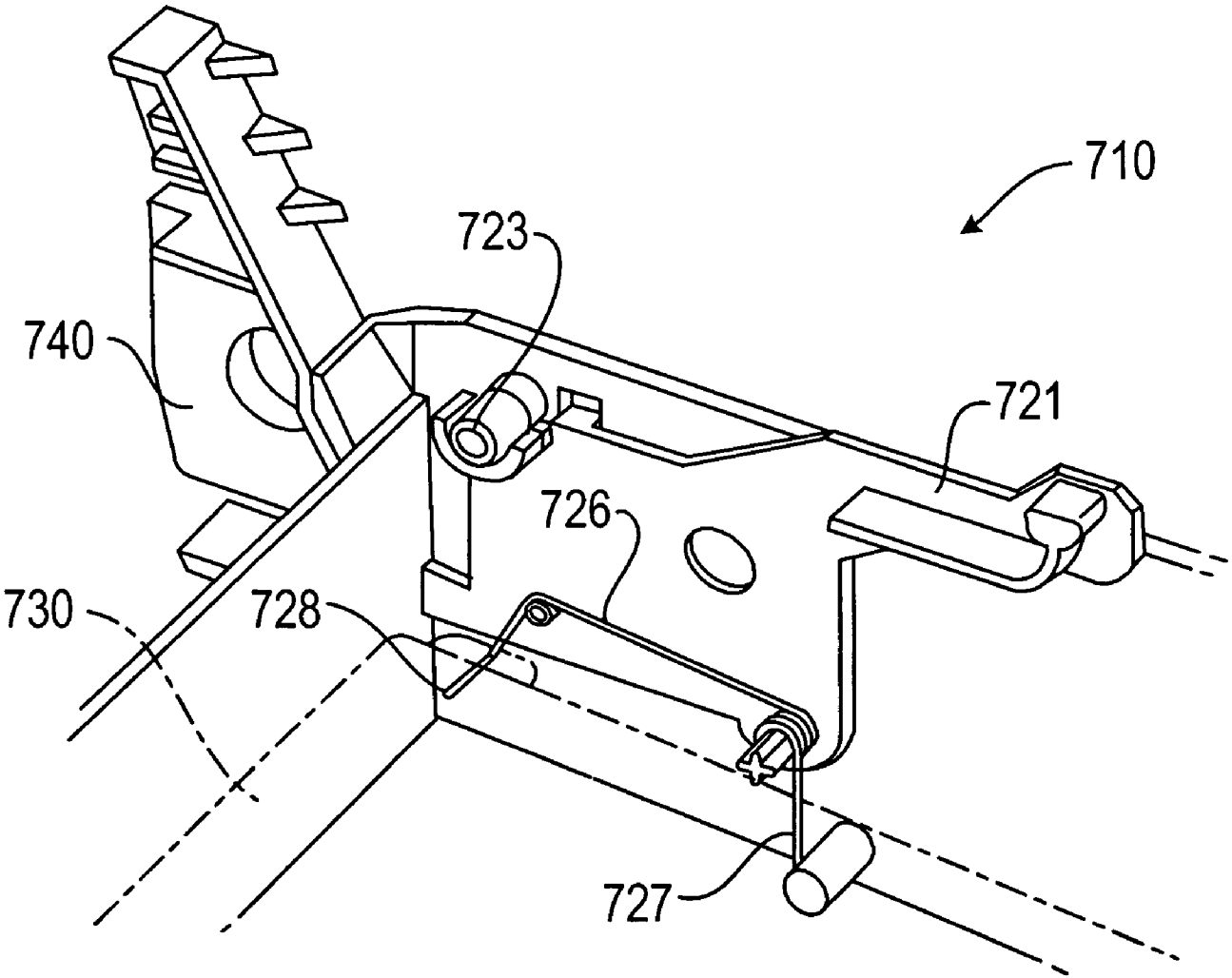

In FIG. 7*b*, more paper has been added to the stack (once again, the paper is not shown). The torsion spring 726 is now under more torsion force, due to the increased weight of the stack of paper, and the second end 728 of the spring 726 is lower. However, the uppermost sheet of paper is still at the picking position, i.e. at the same height as it was in FIG. 7*a*. This is because the extra weight of paper has bent the torsion spring to lower the second end 728 of the spring 726 by an amount corresponding to the extra height of the stack of paper.

Figure 7C:
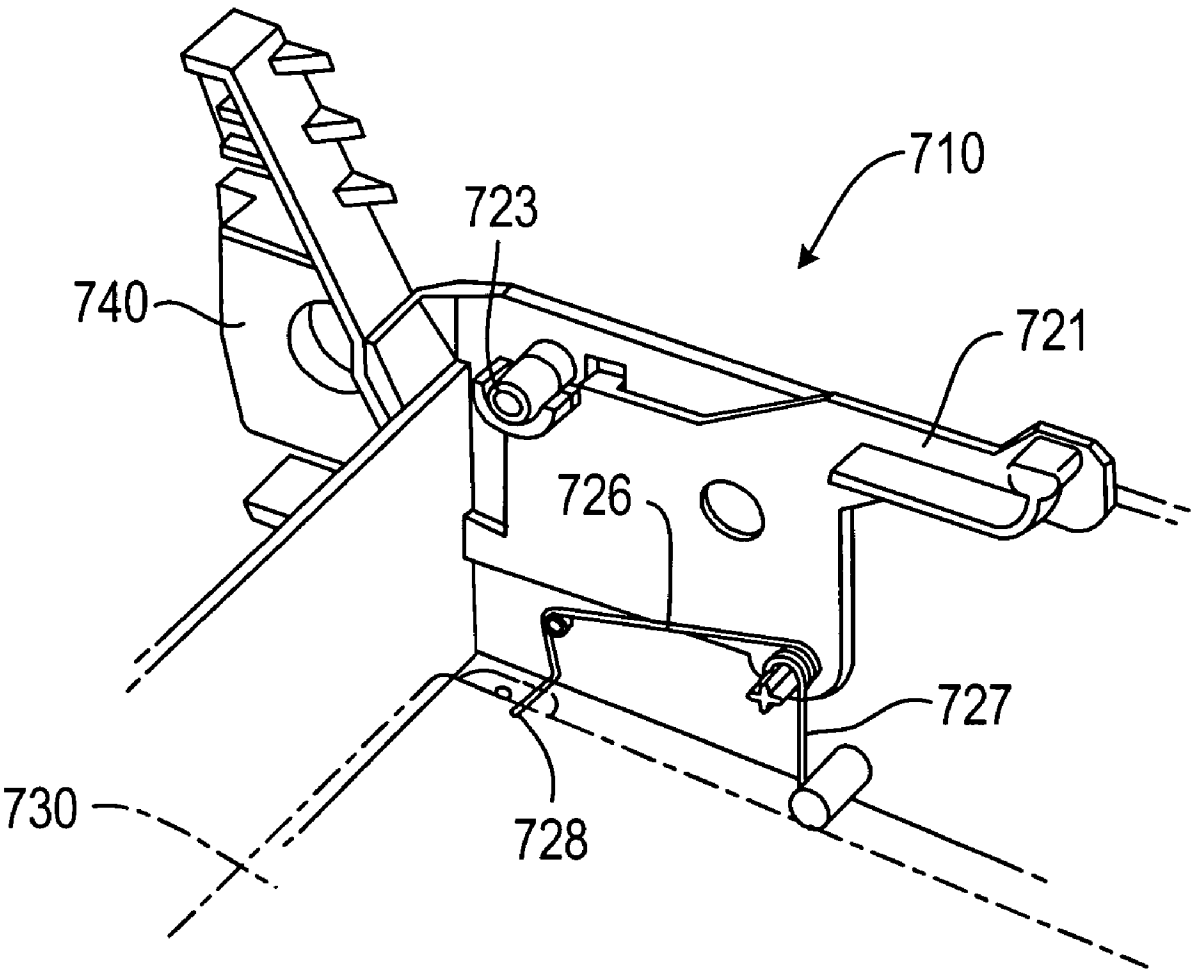

In FIG. 7*c*, still more paper has been added to the stack of paper (once again, the paper is not shown). The torsion spring 726 is now under even more torsion force due to the further increase of weight of the stack of paper. However, the uppermost sheet of paper is still at the picking position, i.e.

at the same height as it was in FIGS. 7*a* and 7*b*. Once again, this is because the extra weight of paper has bent the torsion spring 726 to lower the second end 728, and therefore the paper supporting plate 730, by an amount corresponding to the extra height of the stack of paper. In this way, the top of the stack of paper is retained in the picking position regardless of how much paper is in the stack, up to a maximum stack height that can be accommodated by the tray 710.

Referring to FIGS. 7*a, b* and *c*, as a sheet of paper is removed from the printer by the picking mechanism, the weight of the stack is reduced by a corresponding amount, which reduces the torsion force on the spring 726, which, in turn, raises the second end of the spring 726 and therefore the paper supporting plate 730 by the thickness of one sheet of paper. As this occurs it places the new top sheet of the stack in the picking position to make that sheet available for picking by the picking mechanism. The paper supporting plate 730 keeps the top of the stack in the picking position, even when sheets of paper are removed from the stack. A particular torsion spring is generally able to cover a wide range of paper size and weight. In designing the spring, the worst case scenario is used. The worst case scenario is for a particular sized-tray, for the maximum height, length and width, the heaviest printing paper available is used to compute the torsion spring's elastic requirements. In this way, when lighter paper, or smaller size paper is used, the paper supporting plate 730 will not have any problems lifting the top of the stack to the picking position. The picking position is therefore a minimum height, which the uppermost sheet will always be above, when lighter paper is used. The cylinder 723 acts as a stopper to the paper supporting plate 730 and this prevents the uppermost sheet of a stack of paper coming into contact with the picking mechanism when the picking mechanism is in the "no-pick" position is avoided.

Figure 8:
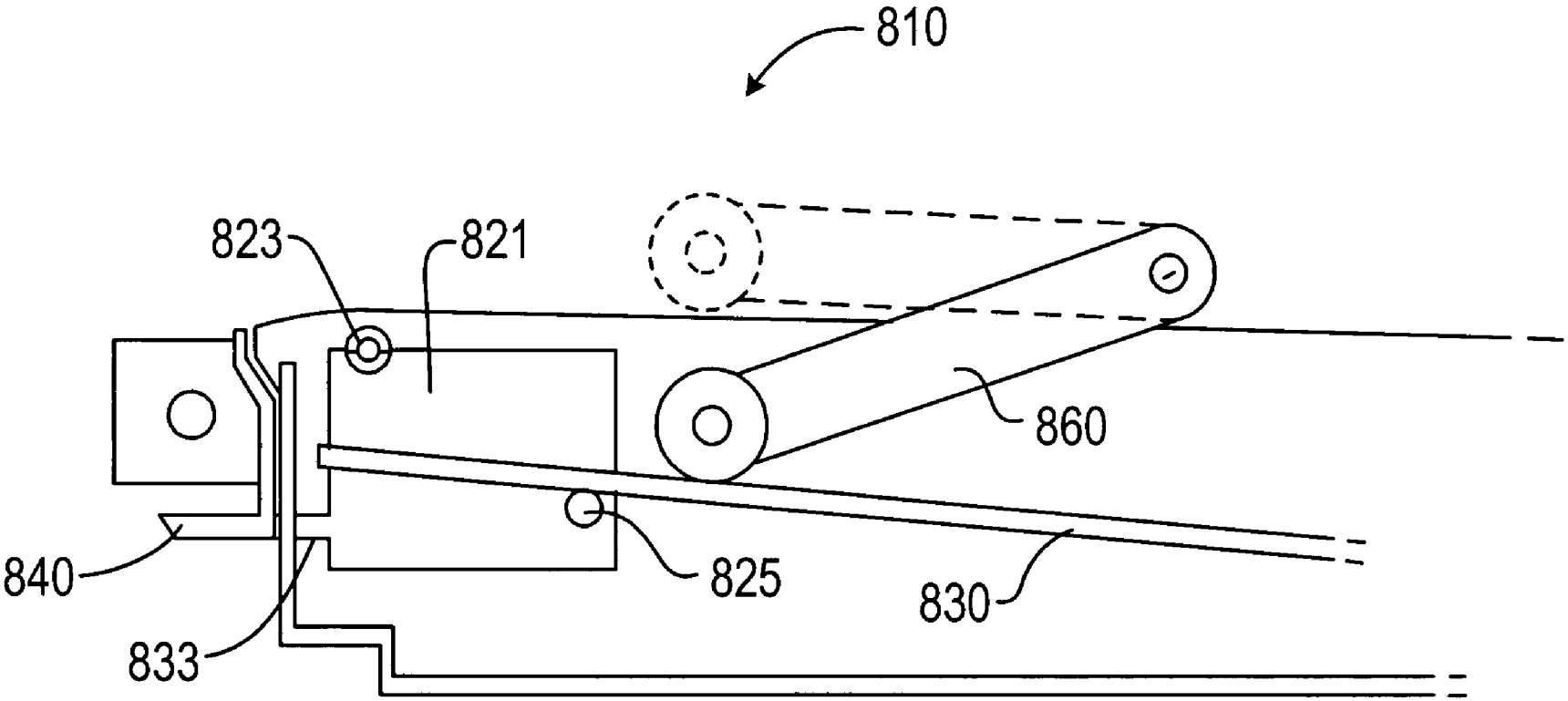
FIG. 8 shows a paper tray mechanism of yet another embodiment of the invention.

A further embodiment of the invention will now be discussed with regard to FIG. 8. FIG. 8 shows a printer paper tray 810 located within a printer. The printer tray 810 is similar to the printer tray of the previous embodiments. The tray 810 of the second embodiment differs from that of the previous embodiments in that no pivotably mounted biasing part is provided. The actuator 821 is of the same or similar design as in the previous embodiments, having a pivotal connection, a tab 833 and a projection 825, is shown in the engaged position and is moved between the engaged and refilling positions as described in relation to the previous embodiments.

The paper supporting plate 830 is of the same design as in the previous embodiment. In this embodiment, the coupling of the actuator 821 and the paper supporting plate 830 is direct. The paper supporting plate 830 rests on the projection 825 of the actuator 821, such that the projection 825 can slide underneath the paper supporting plate 830, and the paper supporting plate 830 is raised and lowered by the rotation of the actuator 821, which causes the projection 825 to be raised and lowered. In order to increase the amount that the paper supporting plate 830 is raised when the actuator 821 is rotated, the projection 825 can be placed further rearward relative to the pivotal connection of the actuator 821. The tab 833 of the actuator 821 can be made longer in order to cause increased rotation of the actuator 821.

The printer into which the tray 810 is placed has an adjustable picking mechanism 860. The picking mechanism 860 is lowered from a retracted or stored position shown in dotted lines into a picking position shown in solid lines by the printer when picking is to be carried out.

As shown in FIG. 8, the level of the paper supporting plate 830 is the minimum picking position height when the printer tray 810 is located in the printer and the actuator 821 is in the engaged position. This corresponds to the maximum deployment of the picking mechanism 860 from its retracted position, shown in FIG. 8. The uppermost sheet of the stack of paper is above this level in order to be picked. This means that the uppermost sheet of the stack is in contact with the picking mechanism 860 when it is engaged, resulting in picking when the picking mechanism 860 is engaged. In this way, all of the paper on the paper supporting plate 830 can be picked. As shown in FIG. 8, the picking mechanism 860 descends to engage each sheet of paper in the stack as it becomes the top-most, until all the paper in the tray 810 has been picked.

In this embodiment, the moveable actuator 821 moves the paper supporting plate 830 away from a position in which paper can be picked, so that the paper does not interfere with the picking mechanism 860 or other parts of the printer as the tray is being removed from or inserted into the printer.

In the above embodiments, the mechanism is disposed towards the front end of the paper tray. However, it is also possible to mount the mechanism towards the rear of the tray, with the hinge situated towards the front of the tray, with the paper being picked by the printer from the rear of the tray. In this case the tab of the actuator may extend laterally outwardly from, and through, a space in a lateral side of the tray, to abut a part of the printer in this way, upon insertion of the printer tray into the printer, to move the actuator into the engaged position.

The paper trays, printers and mechanisms of the present invention have been described above purely by way of example and modifications will present themselves to the person skilled in the art and are within the scope and spirit of the invention, which is not limited to the above examples, but also resides in any individual features and any combinations thereof.

What is claimed is:

1. A paper tray that is insertable into a printer, said paper tray comprising:

a front wall and two side walls on either side of the front wall, each side wall including a retaining stopper extending laterally from an internal surface;

a movable supporting plate for supporting a stack of papers; and an actuator pivotally mounted to the internal surface of each side wall at a location adjacent to the front wall such that said actuator is pivotable about a connection point between the actuator and the side wall, said actuator comprising:

(i) a projection extending laterally toward the supporting plate;

(ii) a torsion spring having a spiral section wound around said projection, a first end whose movement is restrained by said retaining stopper, and a second end that is configured to support a front end of the supporting tray while freely slides underneath the supporting tray, said torsion spring being pivotable about said projection; and (iii) a tab that is movable between a default position, in which said tab protrudes through the front wall and extends outside of the tray, and a retracted position, in which said tab is pushed into the tray, wherein said actuator is configured such that, when the tray is not fully inserted into the printer, the tab is in the default position, when the tray is fully inserted into the printer, the tab abuts against a part of the printer and is pushed into the tray causing the projection to pivot about the connection point in one rotational direction and causing the second end of the torsion spring to pivot about the projection in the opposite rotational direction, and when the tray is pulled out of the printer, the rotational movements of the projection and the torsion spring are reversed.

2. The paper tray of claim 1, wherein the torsion spring is configured to undergo a torsion force when the supporting plate is supporting a stack of papers and the tray is fully inserted, whereby the weight of the stack causes the second end of the torsion spring, and consequently, the front end of the supporting plate to be lowered toward the bottom of the tray by an amount corresponding to the height of the stack.

3. A printer comprising a paper tray according to claim 2.

4. The paper tray of claim 1, wherein the pivoting movement of the projection changes the relative positioning of the projection and the retaining stopper, thereby changing the pivoting movement of the torsion spring.

5. The paper tray of claim 1, wherein a rear end of the supporting plate is pivotally attached to the tray at a rear end of the tray.

6. A printer comprising a paper tray according to claim 1.

7. The printer of claim 6, wherein the tray is arranged so that, when the tray is holding a stack of paper and is fully inserted into the printer, the torsion spring biases the paper supporting plate so that the top of the stack is in a picking position where the uppermost sheet of the stack can be picked by the printer.

* * * * *